US005881584A

United States Patent [19]

Brunoski et al.

[11] Patent Number: 5,881,584

[45] Date of Patent: Mar. 16, 1999

[54] PORTABLE SHOCKPROOF LOCKING MECHANISM

[76] Inventors: Thomas T. Brunoski, 4 Ivy Knoll, Westport, Conn. 06880; Kenneth A. Rissolo, 22 Palomino Dr., New Milford, Conn. 06776

[21] Appl. No.: 748,382

[22] Filed: Nov. 13, 1996

[51] Int. Cl.[6] ..... F05B 67/38; F05B 65/12

[52] U.S. Cl. ..... 70/68; 70/257; 70/278; 70/130; 70/69; 292/144; 292/DIG. 23; 292/DIG. 27; 292/DIG. 41

[58] Field of Search ..... 70/256, 257, 278, 70/130, 133, 150, 68, 63, 67, 69–71, 73; 292/DIG. 25, DIG. 23, DIG. 27, 153, 144, 36, DIG. 41

[56] References Cited

U.S. PATENT DOCUMENTS

| | | | |
|---|---|---|---|
| 1,264,224 | 4/1918 | Tillman | 292/153 |
| 2,459,029 | 1/1949 | Ingres et al. | 292/DIG. 27 |
| 4,492,395 | 1/1985 | Yamada | 292/DIG. 27 |
| 4,570,466 | 2/1986 | Matthews . | |
| 4,768,021 | 8/1988 | Ferraro . | |
| 4,788,838 | 12/1988 | Cislo . | |
| 4,794,268 | 12/1988 | Nakano et al. | 70/257 |
| 4,890,466 | 1/1990 | Cislo . | |
| 5,161,396 | 11/1992 | Loeff . | |
| 5,344,010 | 9/1994 | Dyer et al. . | |
| 5,350,150 | 9/1994 | Fiore . | |
| 5,575,515 | 11/1996 | Iwamoto et al. | 292/DIG. 25 |
| 5,664,812 | 9/1997 | Marinoni | 292/153 |

FOREIGN PATENT DOCUMENTS

| | | | |
|---|---|---|---|
| 726391 | 1/1966 | Canada | 292/153 |
| 5427 | of 1911 | United Kingdom | 292/DIG. 27 |

*Primary Examiner*—Darnell M. Boucher
*Attorney, Agent, or Firm*—Ware, Fressola, Van Der Sluys & Adolphson LLP

[57] ABSTRACT

For a mobile door or container, a lock that will hold firm against shock. The lock can be opened using a keypad to turn on a motor that disengages it, or manually, using a key. To disengage the lock, a shockproofer element of the lock includes components that must first be pivoted about one axis and components that must then be pivoted about a second, different axis, usually nearly perpendicular to the first axis. The lock resists opening under shock loading because the two pivoting rotations about different axes must be made to occur in a particular sequence, and cannot occur simultaneously.

19 Claims, 13 Drawing Sheets

FIG. 2
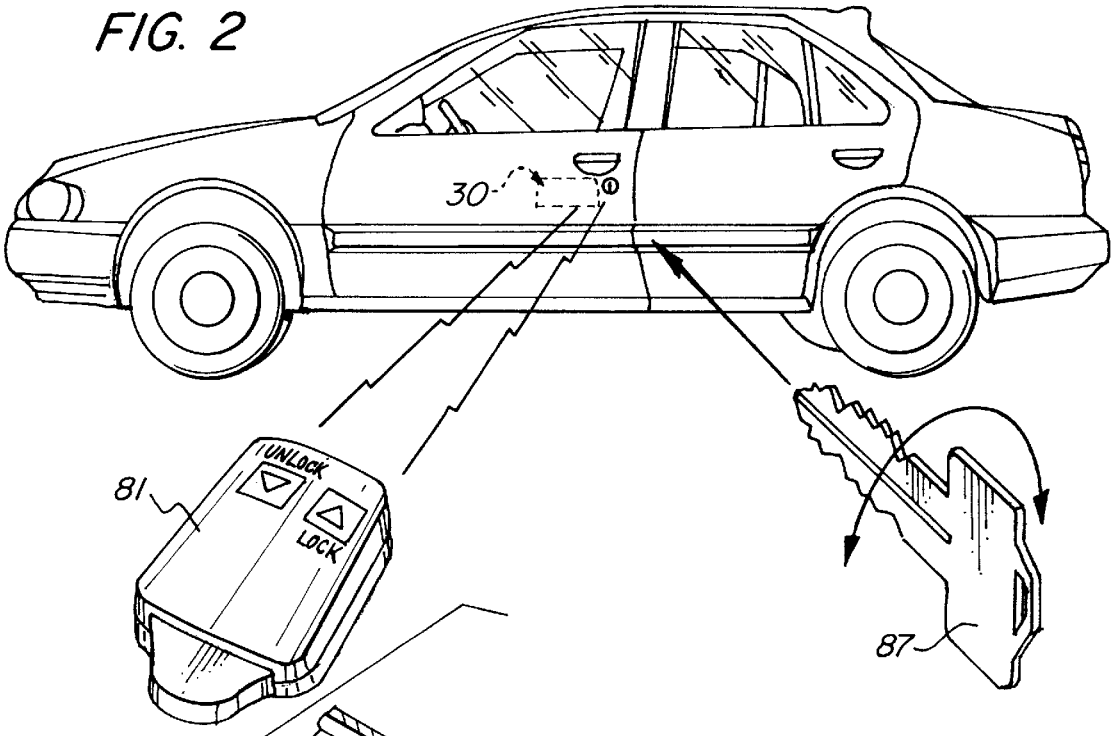
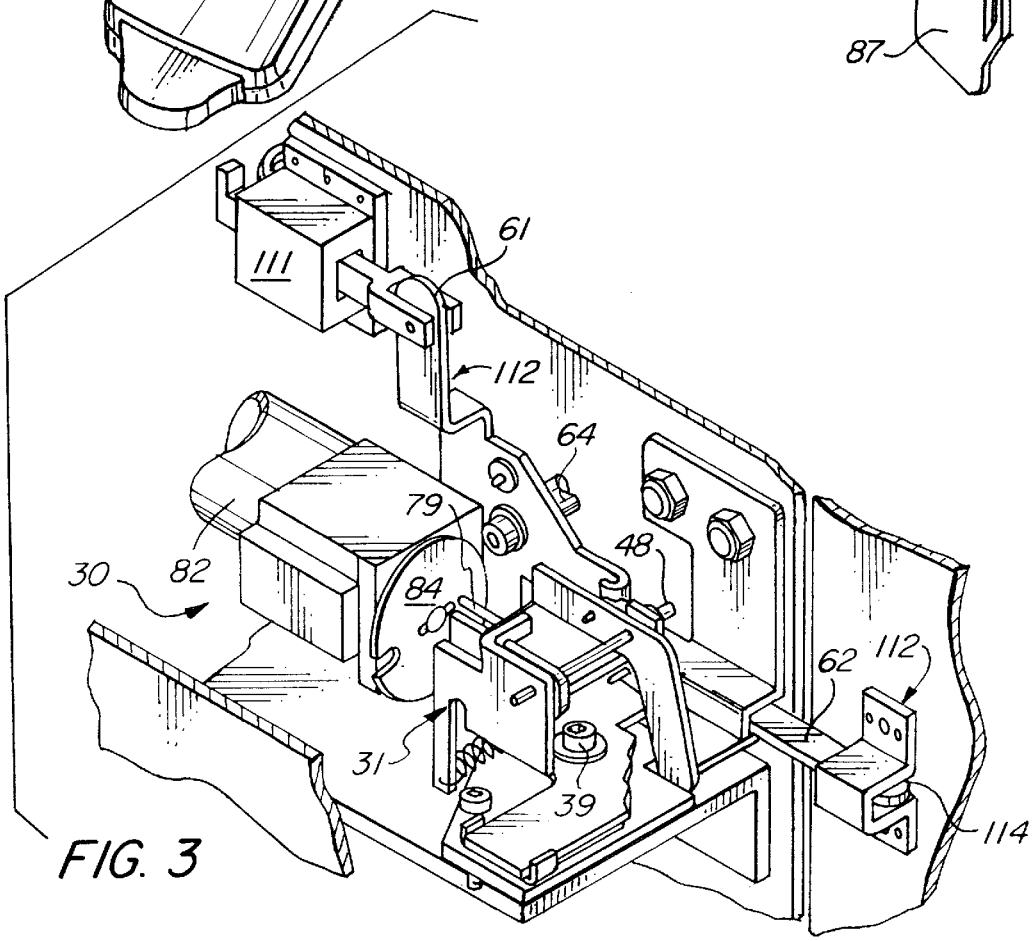
FIG. 3

PORTABLE SHOCKPROOF LOCKING MECHANISM

TECHNICAL FIELD

The present invention pertains to the field of locking fasteners. More particularly, this invention relates to a shockproof locking mechanism for holding locked a portable case or mobile door, such as a car door.

BACKGROUND OF THE INVENTION

There are a number of applications of a lock in which it is desirable for the lock to be shockproof. Examples include a gun container and a car door. A shockproof lock will remain engaged despite inadvertent or intentional shock of the locked container.

A shockproof lock eliminates the danger and risk of the container opening by accident or by force. In the collision of an automobile with another automobile or a stationary object, the shock experienced by the automobile can be transmitted to the locks of the car doors, which may then accidentally open, permitting the occupants to be thrown from the car and seriously injured. In the case of a container for a firearm, a shockproof lock will prevent brute tampering—such as dropping the container from a height—from disengaging the lock and allowing access to the firearm by someone other than the owner. Some states have passed laws holding the owner of a firearm liable for use of the firearm by another, and such risks can often be reduced or eliminated by the use of the present invention.

Some prior art is known to the applicants, including U.S. Pat. No. 5,161,396 to Loeff which discloses a tamperproof lockable firearm case, in which the lock is made tamperproof by controlling the opening and closing of the lock using a computer, which opens the lock only after keys on an attached keypad are pressed in proper sequence. The tamperproof lock of Loeff is not shockproof; it may be opened as the result of a jarring impact. The mechanical elements of the tamperproof lock of Loeff are not designed to withstand shock; they comprise a conventional locking mechanism.

U.S. Pat. No. 5,344,010 to Dyer et al. discloses a handgun case with lock and block designed against prying and jimmying, that protects against an attempt at opening the case by application of non-shocking (non-jarring) forces. The lock of Dyer et al. is not shockproof.

U.S. Pat. No. 4,788,838 to Cislo discloses a lock box for pistols, in which the closed compartment is only accessible by selecting the code that unlocks a latch to open the compartment. This lock box is similar in concept to the tamperproof lockable firearm case of Loeff. It is not shockproof. U.S. Pat. No. 4,890,466 also to Cislo discloses an improved apparatus to lock a handgun within a compartment while the compartment is lockable to a stationary object using a detachable bracket. The locking mechanism of this improved apparatus is similar in its functioning to the lock of the earlier patent by Cislo; it is not shockproof, nor is it designed to be shockproof.

All of the prior art known to the applicants allows the possibility that striking the container hard enough will cause elements of the lock to move relative to each other in a way that permits the container to open. None of these locks include elements and a means of interaction designed to resist opening as a result of jarring impact.

SUMMARY OF THE INVENTION

The present invention provides for locking a container or mobile door, such as a car door, and holding tight against shock loading. Of particular value is that the invention comprises an element, called a shockproofer, that is "freely floating" relative to an element that would cause the action of the shockproofer required to engage or disengage the lock. Because this shockproofer is freely floating, i.e. not mechanically linked to any driving element, different driving elements can be used in an embodiment of the present invention to unlock the device. For example, one embodiment of the present invention provides as drivers of the shockproofer a manually operated key and a keypad activated electric motor, either of which causes shockproofer components to undergo the first tilting and then swiveling action required for the lock to disengage. Manual actuation thus provides a useful alternative actuating mode in case, for example, of low battery voltage.

With this free floating shockproofer, the present invention can be tailored quite particularly to specific applications. The means to drive the shockproofer can for example be made increasingly tamperproof, as the situation merits, or be made easier to operate if the application calls for being able to open the lock more quickly. It is even possible to have a remote-controlled motor instead of the keypad-controlled motor tilt and swivel the driven elements of the shockproofer.

Besides the obvious advantage in using a shockproof lock in an automobile door, the present invention can be used as a lock for a portable gun case. Not only can the gun case be made tamperproof, that is proofed against picking the lock or forcing the lock by prying, the case can be proofed against accidental or intentional unauthorized opening as a result of sustaining shock loads. Whether this level of precaution is necessary to avoid liability under the laws of some states, it is in fact a significant precaution in view of the ease or likelihood that a container would experience shock, either intentionally or by accident.

BRIEF DESCRIPTION OF THE DRAWINGS

FIG. 2 shows an automobile that uses the locking mechanism of the present invention.

FIG. 3 is a fragmentary perspective view of the present invention embodied for use in an automobile door.

DESCRIPTION OF A PREFERRED EMBODIMENT

Figure 1A:
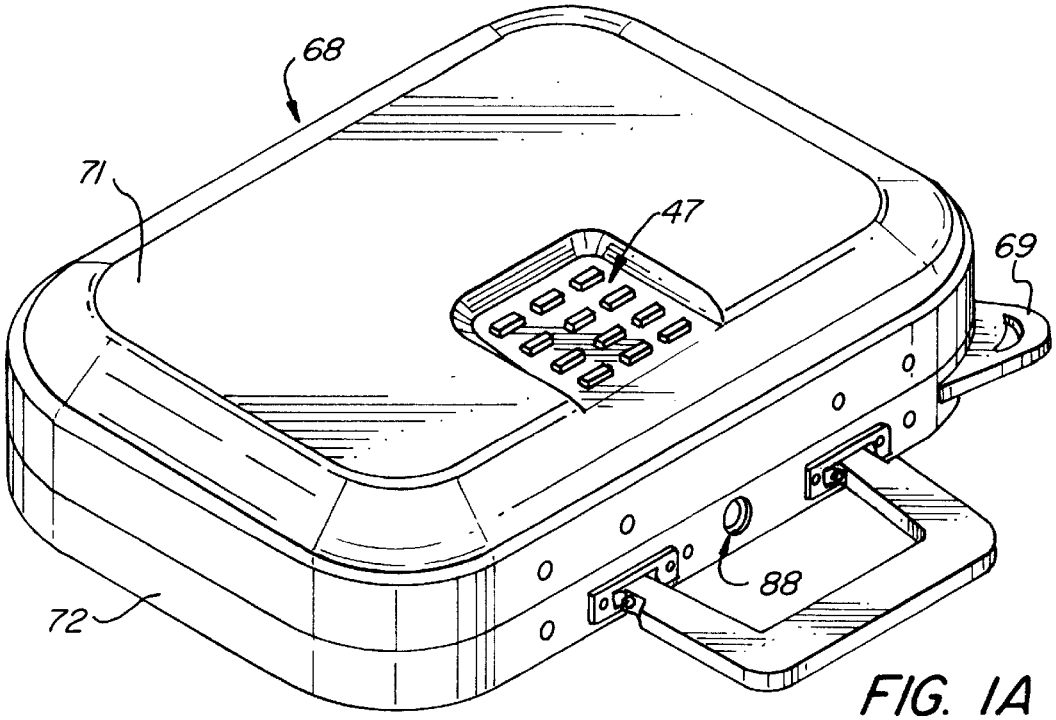
FIG. 1A is a perspective view and FIG. 1B is a top plan view, partially cut away, both showing a hand-portable container, used as a hand-gun safe, employing the shockproof locking mechanism of the present invention.
Figure 1B:
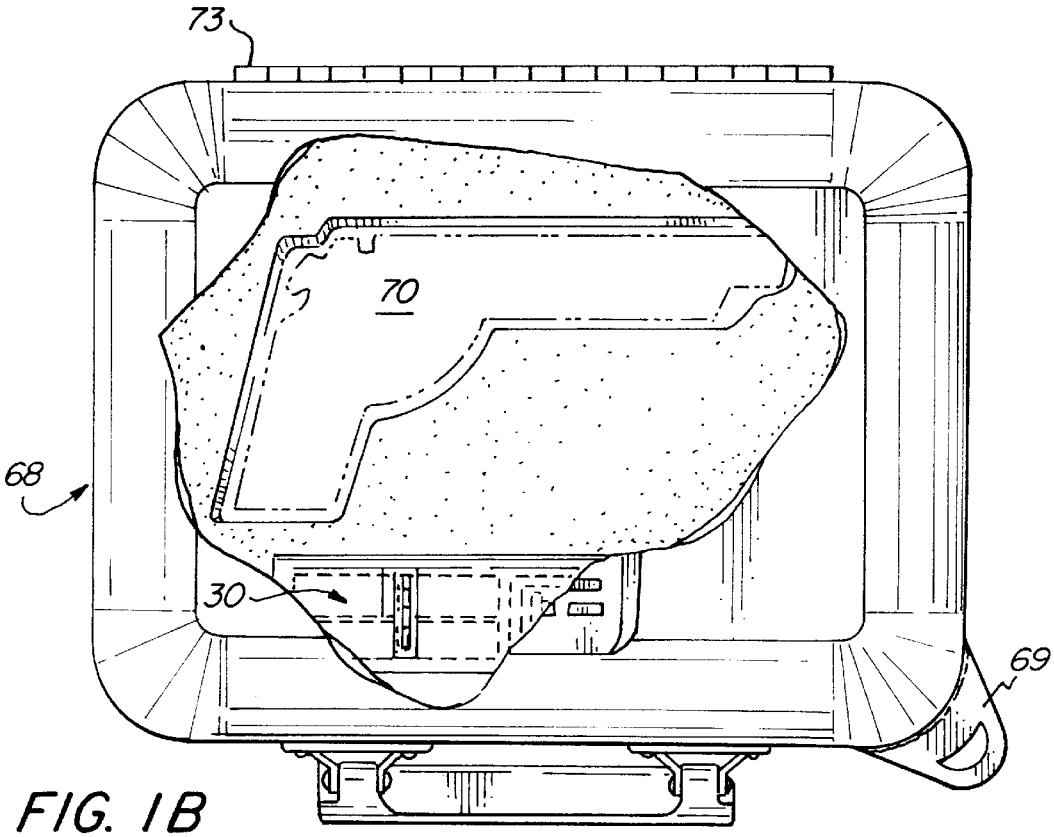

The present invention is a shockproof locking mechanism that can be used in different applications, as described above. One such application is that of a portable gun case. Referring now to FIG. 1A, a portable gun case 68 is shown in the closed position from the outside. The gun case includes a keypad 47 which may be used to open the case, a keylock 88 which provides an alternative means of opening the-case, and a docking tab 69, which may be used to secure the case to a fixed station or post. The case has a lid 71 and a base 72. FIG. 1B shows the portable gun case 68 cutaway to show a handgun 70 in dot-dash lines inside the case, and the location of the locking mechanism 30 of the present invention.

FIG. 2 shows an automobile that uses the locking mechanism 30 of the present invention. In the embodiment illustrated, the locking mechanism is controlled using either a lock remote controller 81, or a key 87. The remote controller sends a coded signal to the locking mechanism to unlock the door. This signal prompts an actuating motor, powered by the car battery, to make one revolution, which disengages the locking mechanism, as will be described below. Turning the key 87 also actuates the motor, unlocking the door. Alternatively, the key 87 may be made to manually disengage the lock, without involving the motor.

FIG. 3 shows the locking mechanism of the present invention in an embodiment for an automobile door. For this application, as in all embodiments, the locking mechanism 30 includes a shockproofer 31, and a locking lever 61. Depending on the application, the shockproofer may be driven to disengage the locking mechanism by various means; such as a motor 82, as shown in FIG. 3. As will be explained in more detail below, as the motor turns through one revolution, a motor disc pin 79, protruding from a motor disc 84 pushes on first one surface and then another surface of the shockproofer, causing parts of the shockproofer to pivot first about one axis centered on a turret cap shaft 48 and then about a second, approximately perpendicular axis centered on a turret post 39. This tilting and then swiveling allows the locking lever 61 of a car door lockbar assembly 112 to pivot about a locking lever shaft 64 (under the force of a spring, not pictured), retracting a lockbar arm 62 from a lockbar retaining slot 114, and so unlocking the car door.

The tilting about the (turret cap) shaft 48 must precede the swiveling about the (turret) post 39 because the tilting lifts part of the shockproofer 62 out of a base notch 52. Swiveling about the post 39 is mechanically prevented by the base notch 52 until tilting about the shaft 48 has occurred.

In the embodiment shown in FIG. 3, both the key 87 and the lock remote controller 81 of FIG. 2 are designed to actuate the motor 82, which disengages the lock by rotating its motor disc 84 through one revolution, as will be described in more detail below. The key 87, instead of actuating the motor, may be made to push on various shockproofer surfaces, as will be described below, causing the tilting and then swiveling action required to disengage the lock.

To lock the car door, the door must first be closed—which latches it shut using the door latching mechanism that is provided as part of the car door—then a signal is sent to a lever solenoid 111 causing it to pull the locking lever 61 to the vertical position, which is the position shown in FIG. 3. The signal can be caused either by turning the key 87, by hitting the lock button of the lock remote controller 81, or by depressing an actuator in the car to automatically lock the doors. When the locking lever reaches the vertical orientation, the shockproofer 31 is mechanically free to respond to restoring forces provided by sturdy springs; these forces first unswivel and then untilt the shockproofer. The shockproofed lock is then engaged.

Figure 4A:
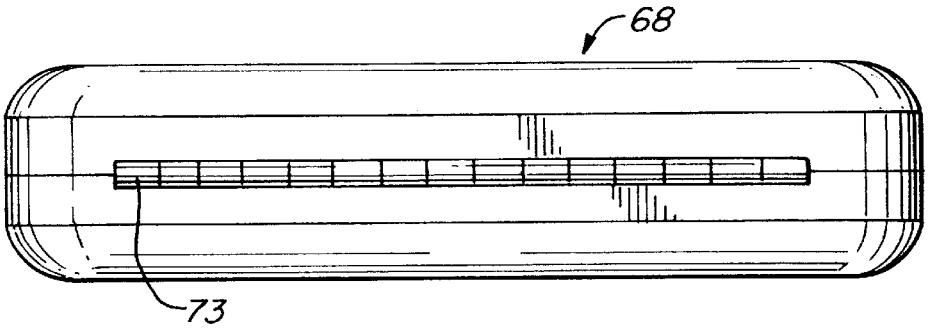
FIG. 4A is a rear elevation view and FIG. 4B is a perspective view, in the open position, of the handgun case of FIG. 1B.
Figure 4B:
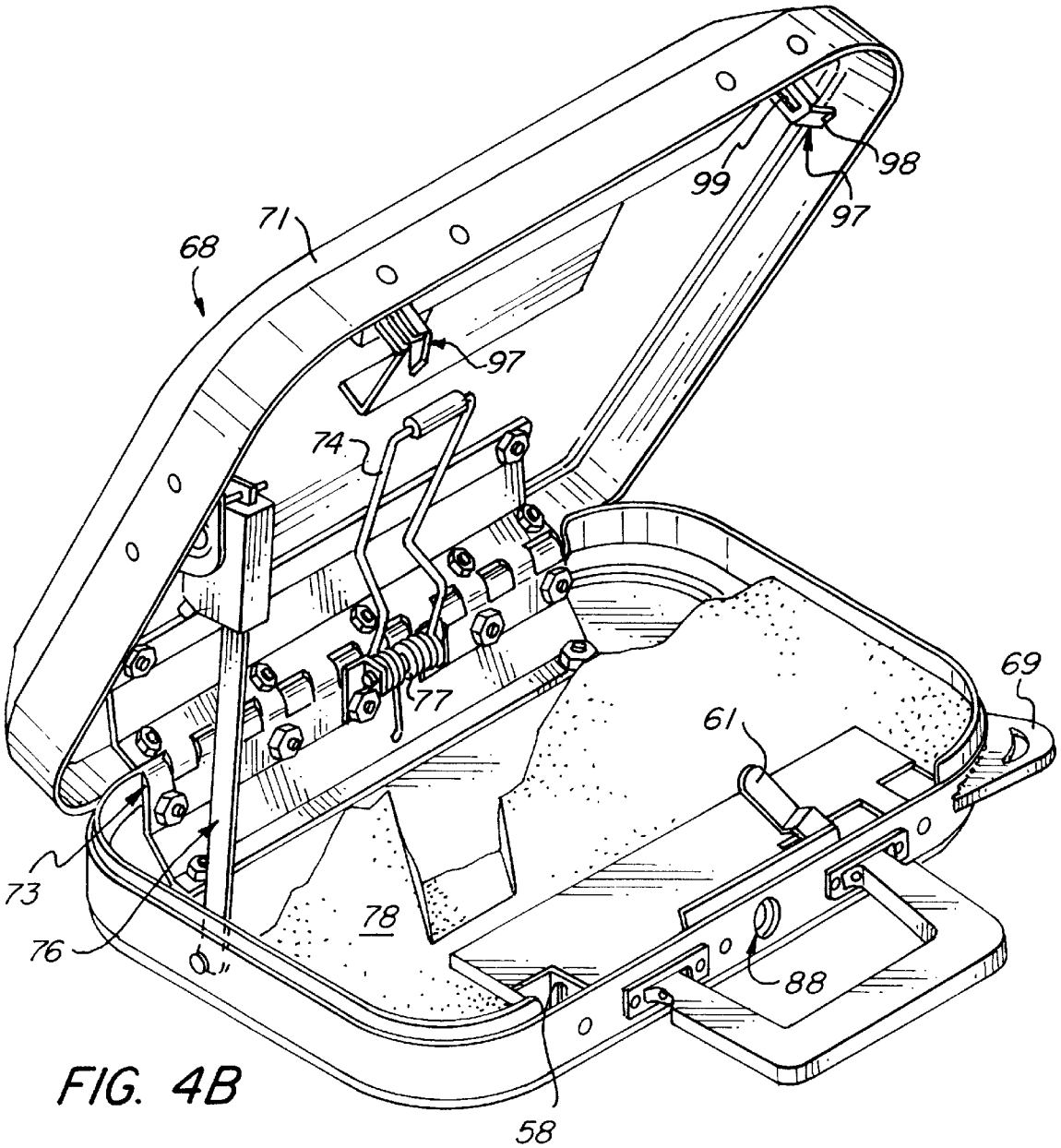

FIGS. 4A and 4B show two views of a portable security case employing the present invention. FIG. 4A is a rear view of the portable handgun case showing a continuous hinge on the back of the case about which the lid pivots as the case opens.

FIG. 4B is a view of the handgun case opened, showing the rest of the continuous hinge 73, an opener spring arm 74 that pushes the case open when the lock disengages, an opener spring 77 that drives the opener spring arm, and an opener guide 76 that dampens the action of the opener spring 77 so the case opens smoothly. Also shown in FIG. 4B are latches 97 attached to the lid 71, each latch having a latch slot 99 and a latch ramp 98. Each latch swivels about its point of attachment to the lid, so that when the lid is closed one of the lockbar arms 63 (FIG. 6) of the locking mechanism rides on down the latch ramp, pushing the latch so that it rotates about its point of attachment until the lockbar arm drops into the latch slot 99 (FIG. 7).

Figure 8A:
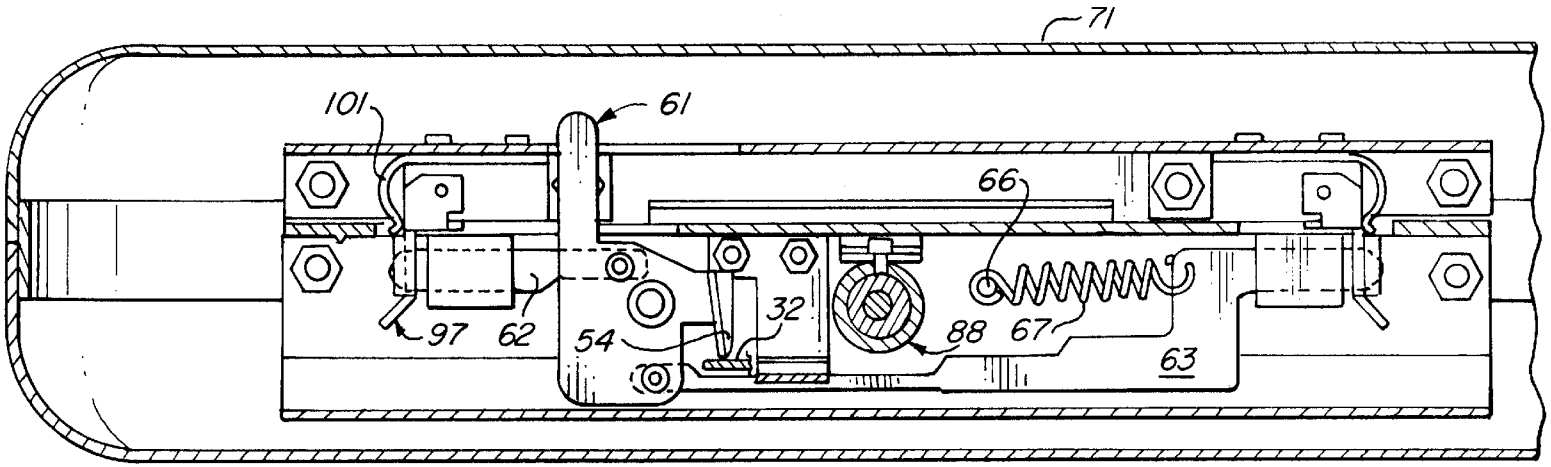
FIG. 8A and FIG. 8B show two internal elevation views of the handgun case, both looking from the inside toward the locking mechanism, in the locked position and in the unlocked, open positions, respectively.
Figure 8B:
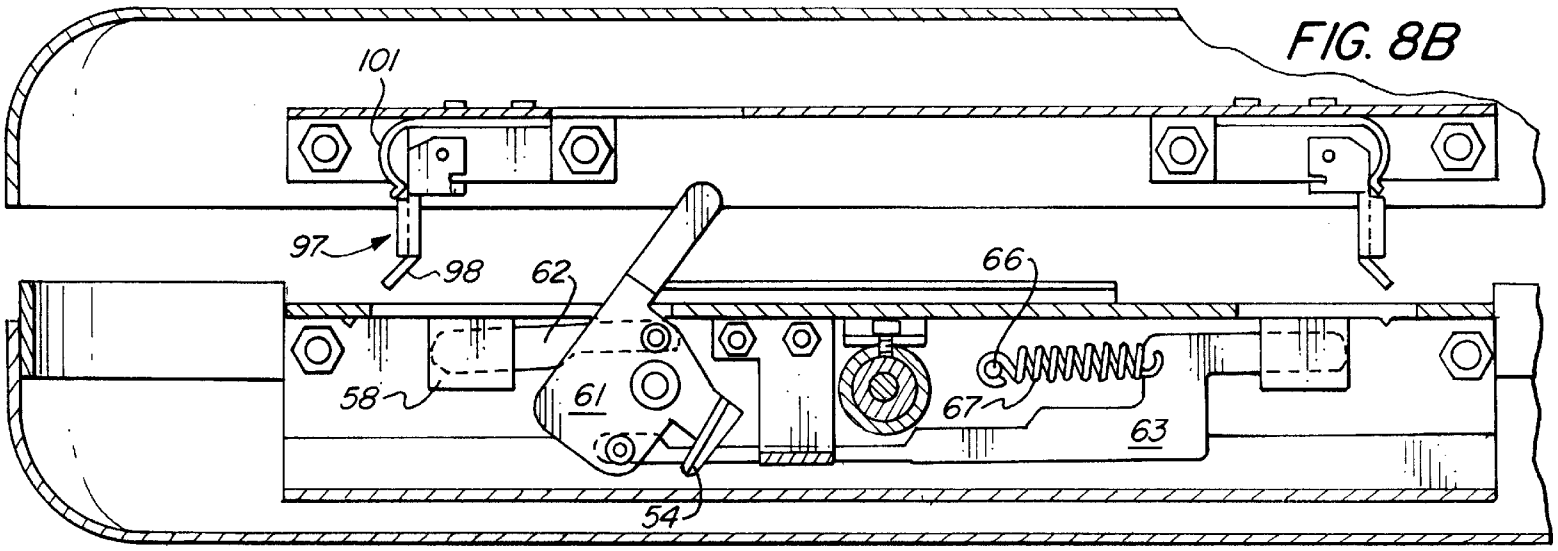

FIG. 4B also hows a locking lever 61 that is used to arm the locking mechanism. With the locking lever in the disengaged position, as shown in FIG. 4B and FIG. 8B, the lid of the case may be shut but the lock will not engage. To engage the lock, the locking lever must be armed before shutting the case. The lock is armed by gripping the locking lever and pivoting it to vertical, as shown in FIG. 8A. Then when the lid is shut, the lock will engage.

Figure 5:
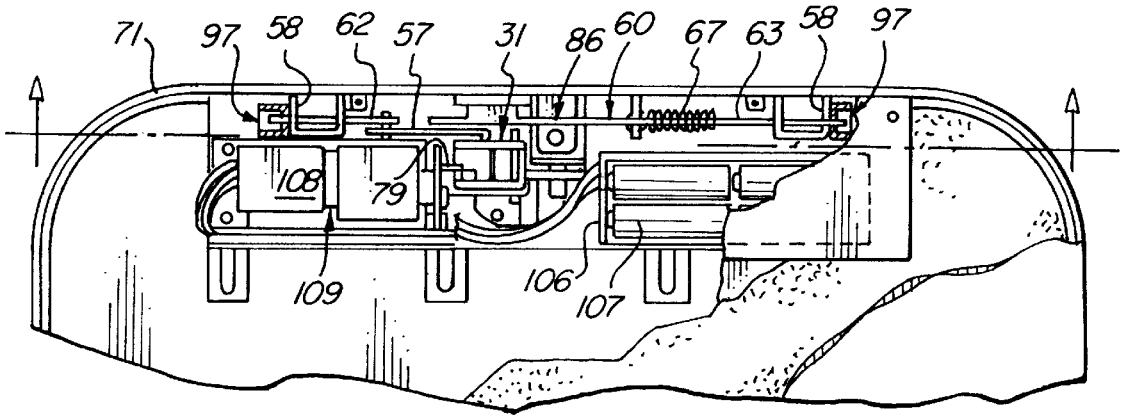
FIG. 5 is a fragmentary cutaway plan view of the handgun case of FIG. 1B, showing the locking mechanism of the present invention.

Referring now to the cutaway view of FIG. 5 and also to FIGS. 8A and 8B, the locking mechanism of the present invention is shown looking from above the case down onto the front half of the case. The FIG. 5 view shows the shockproofer 31 and the lockbar assembly 60, including a key-side lockbar arm 63 and a motor-side lockbar arm 62. These lockbar arms are extended and retracted by pivoting the locking lever 61 about the locking lever shaft 64. The lockbar arms are held in the open, retracted, position by a lockbar spring 67 (FIG. 8B).

In the locked state, as seen in FIG. 8A, the lockbar arms extend through the U-brackets 58 (see also FIG. 5) on the key-side and on the motor-side and through their slots in the latches 97. The latches 97 are pivotably attached to the lid of the case and the rest of the locking mechanism is attached to the base of the case (see also FIG. 6) so that the lid is prevented from opening while the lockbar arms pierce the slots of the latches 97.

FIG. 5 also shows some parts, used in this embodiment, of the two different drivers of the shockproofer 31. One driver is a manually operated key. FIG. 5 shows the keylock cylinder 86 just next to the shockproofer 31. Another driver in this embodiment is a motor 109, shown in FIG. 5, that rotates a motor disc pin 79 causing the shockproofer 31 to perform the action required to allow the locking lever finger 57 to rotate and thereby retract the lockbar arms 62 and 63 from the slots in the latches 97. Also shown in FIG. 5 is the electronic circuitry 108 that provides the interface between the keypad 47 (FIG. 1) and the motor 109. For power, the motor uses batteries 107 stored in the battery compartment 106.

Figure 6:
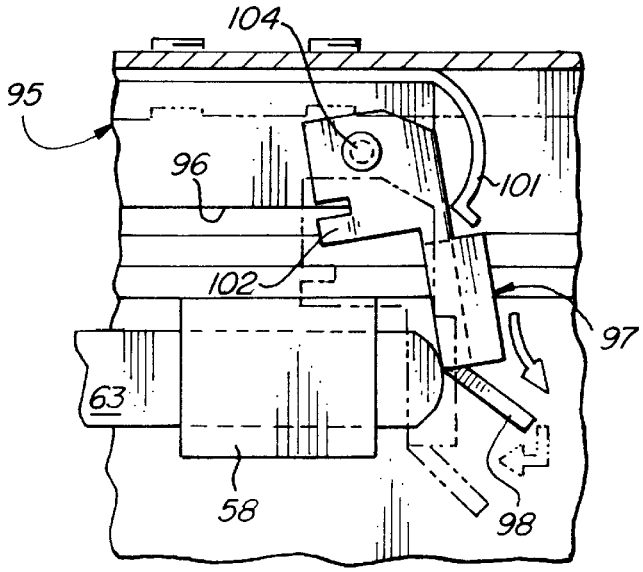
FIG. 6 is an enlarged fragmentary cross-sectional elevation view from inside the almost closed case, showing the pivoting latch that holds the lockbar arm of the present invention.
Figure 7:
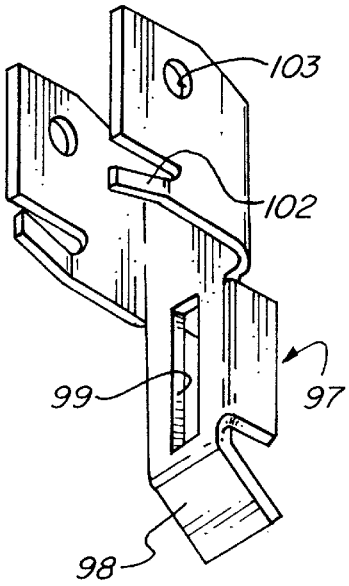
FIG. 7 is an enlarged perspective view of the pivoting latch.

FIG. 6 is an elevation view of the latch assembly 95 for the gun case embodiment of the present invention, looking from inside the case lying on its base 72 (FIG. 1); it shows the action of one of the latches 97 (the latch on the key side of the shockproofer) as the case is closed. If the locking mechanism has been armed as explained above (by manually pivoting the locking lever by gripping the locking lever handle and pivoting the locking lever about the locking lever shaft), the lockbar arm 62 and 63 are extended, as shown in FIG. 8A. As the lid is lowered, on both the key side and motor side, a latch ramp 98 rides down on a lockbar arm causing the latch to rotate about a latch pivot 104, restrained by a latch spring 101, until the lockbar arm can pierce the latch slot 99 (FIG. 7), locking the case. Each latch 97 is held on a lockbar arm 62 and 63 by the tension of a sturdy latch spring 101. When the lid is closed so that each latch 97 is forced to pivot about the latch pivot 104, in opposition to the force exerted by the latch spring 101, latch stops 102, offset angularly from each latch 97 (FIG. 7), come to rest against latch catches 96 attached to the lid 71 of the case (FIG. 8A), preventing the latches from over-rotating and the lockbar arms 62 and 63 from binding on the inside of the latch slots 99.

FIG. 7 is a detailed perspective drawing of the latch 97, showing the latch ramp 98, the latch slot 99, the offset latch stops 102 and the latch pivot holes 103 about which the latch pivots on pivot pin 104 as the lid is closed.

FIGS. 8A and 8B show two views of the locking mechanism of the present invention from the inside of the case looking toward the front. These views show the action of the locking lever 61 and the resulting extension and retraction of the lockbar arms 62 and 63. From FIG. 8B it is clear that the lid may be closed but the container not locked, unless the locking lever 61 is in the vertical position as shown in FIG. 8A. In the disarmed, pivoted orientation of the locking lever 61 (FIG. 8B), the lockbar arms 62 and 63 are retracted and do not pierce the latch slots 99 of the latches 97 (FIG. 7).

Figure 9:
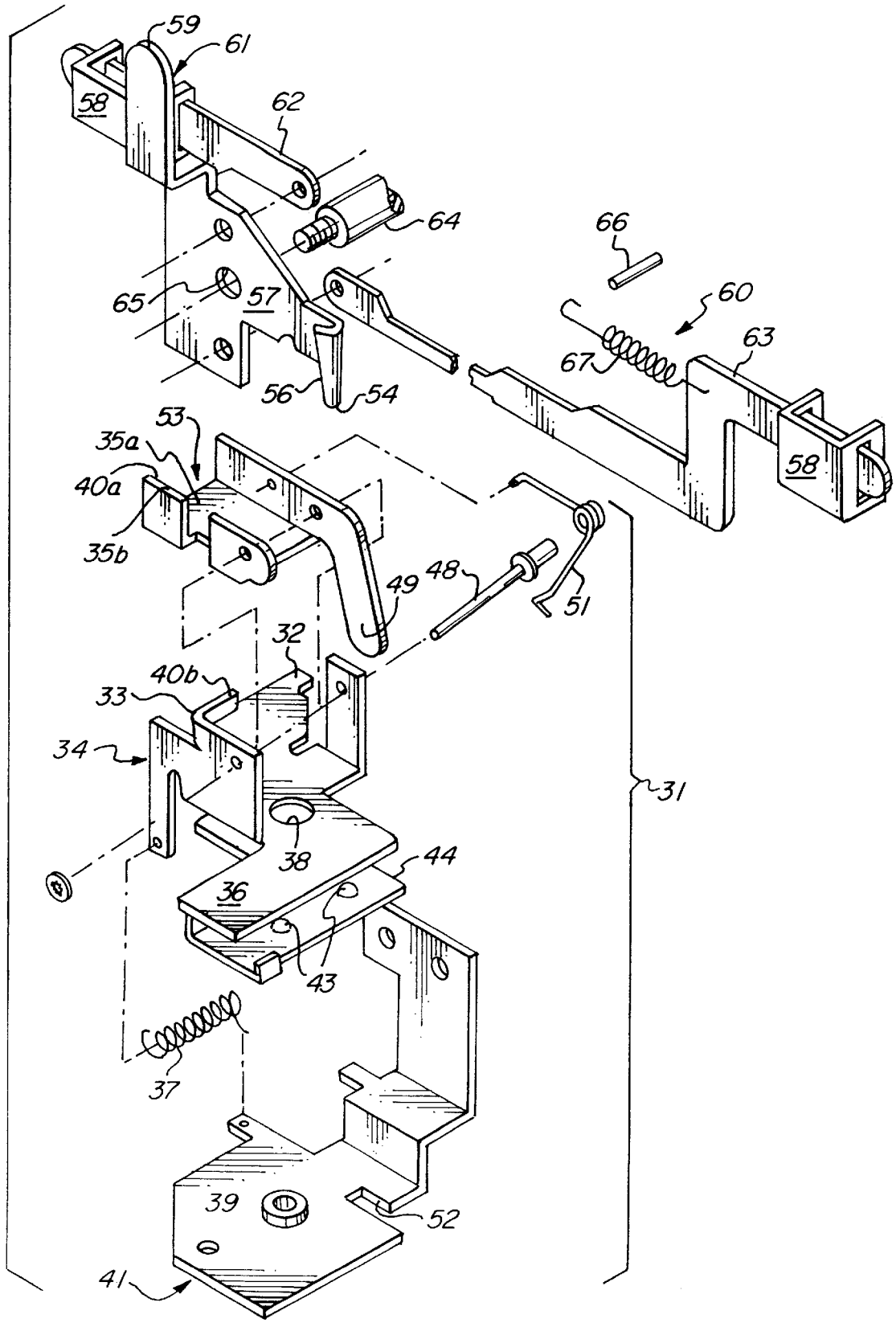
FIG. 9 is an exploded perspective view of a shockproofer mechanism and retracting lockbar assembly of the present invention.

FIG. 9 is an exploded view of the shockproofer 31 and lockbar assembly 60. The shockproofer assembly 31 includes a fixed shockproofer base 41 having a central upstanding turret post 39, a pivoting turret 34 pivotable about post 39, and a tilting turret cap 53 mounted for downward pivoting about a turret cap shaft 48 and having a depending turret cap finger 49.

In the lockbar assembly there is a locking lever 61 and locking lever handle 59 for gripping to pivot the locking lever 61 about the locking lever shaft 64, which extends through the lockbar shaft hole 65 in locking lever 61. In the locked state of the locking mechanism (FIG. 8A), the locking lever handle 59 is vertical. In that state, a locking lever stop 54 at the foot of a locking lever finger 57 rests on a shockproofer tab 32, shown in FIG. 13A and in the central portion of FIG. 9. Only when this shockproofer tab 32 is made to pivot out from beneath the locking lever stop 54, as part of the pivoting action of the shockproofer about the turret post 39, is the locking lever 61 able to rotate, under the force of the lockbar spring 67, about the locking lever shaft 64 and so retract the lockbar arms 62 and 63. The lockbar spring 67 is attached to the key-side lockbar arm and the lockbar spring peg 66. The lockbar arms extend through fixed U-brackets 58 on the motor side and on the key side. These U brackets and spring peg 66 are rigidly attached to the inside of the base of the case 72.

The shockproofer tab 32 cannot rotate from beneath the locking lever stop 54 of the lockbar assembly 60 unless the shockproofer is pivoted counter-clockwise, looking from above, about the turret post 39 held in turret post hole 38. But this pivoting is prevented while a turret cap finger 49 of the turret cap 53 is held in the base notch 52 in the shockproofer base 41. For the shockproofer tab 32 to move out from beneath the locking lever stop 54, first the turret cap 53 must be tilted about the turret cap shaft 48; the turret cap is held in the untilted state by the turret cap spring 51. To tilt the turret cap, a downward force, looking from above, must be applied to the tilt surface 35. This tilting force must overpower the force of the turret cap spring 51. Once the turret cap 53 is tilted, lifting the turret cap finger 49 out from the base notch 52, a force must be applied against the swivel surface 40 to pivot the turret cap and shockproofer turret 34 about the turret post 39, thereby rotating the shockproofer tab 32 from beneath the locking lever stop 54.

Thus tilting the turret cap about the axis of shaft 48 and then swiveling the turret cap and turret about a second axis 110 of post 39 moves the shockproofer tab 32 from beneath the locking lever stop 54, permitting the lockbar spring 67 to retract the lockbar arms. The lockbar arms then withdraw from the latch slots 99 of the latches 97 attached to the lid of the container (FIG. 6. As shown in FIG. 4, this withdrawal allows the sturdy opener spring 77 to push the lid 71 open, pivoting about hinge 73. What remains to be shown is how to apply a force on the tilt surface 35 and then the swivel surface 40.

Figure 10:
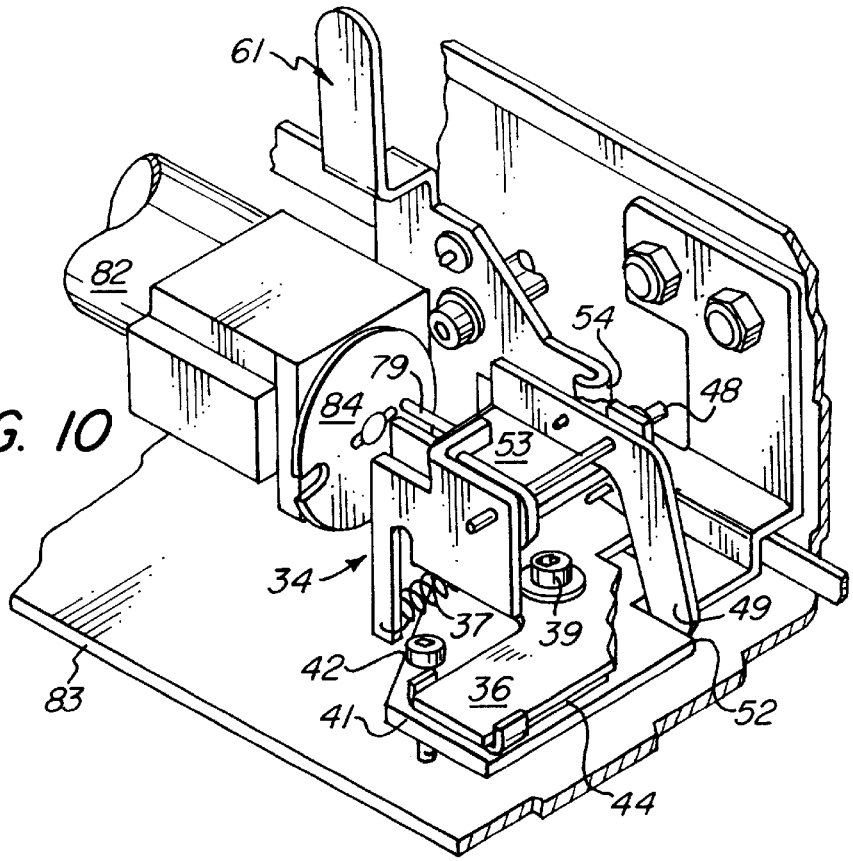
FIG. 10 is a fragmentary perspective view of the present invention, including the shockproofer actuating motor and lockbar assembly.

One way the tilting and then swiveling can be forced is to use a motor. FIG. 10 shows a motor 82 with a motor disc 84 having an axially extending motor disc pin 79 used to tilt and then swivel the shockproofer elements. When the motor 82 is actuated by entering a programmed code into the keypad 47 ( FIG. 1), it rotates its motor disc 84 one complete turn and then shuts off. As the motor disc pin 79 protruding from the motor disc 84 rotates clockwise, as seen from the shockproofer 31, it first pushes on the motor tilt surface 35*a* of cap 53 raising the turret cap finger 49 up out of the base notch 52 and then pushes on its motor swivel surface 40*a*. Then the lateral force of pin 79 against motor swivel surface 40*a* causes both the turret cap and shockproofer turret 34 to swivel about the turret post 39, against the restoring force of the shockproofer spring 37. Looking at the shockproofer from inside and at the back of the case, the tilt is a counter-clockwise pivoting about the turret cap shaft, and looking from above, the swiveling of the turret cap and shockproofer turret is a counter-clockwise pivoting about the turret post.

FIG. 10 and FIGS. 14A, 14B, and 14C help visualize how this circular motion of the motor disc pin 79 provides the forces in the two nearly perpendicular directions. In FIG. 10, the motor disc pin 79 ( see also dash lines in FIG. 14A) is just beginning its clockwise rotation, looking at the motor disc from the position of the shockproofer. The motor disc pin will be moving generally downward in the beginning of its circular motion, and during that part of its motion it pushes down on the motor tilt surface 35*a* of FIG. 9 of the shockproofer turret. When it reaches the bottom of its circular motion it begins to push to the left, against the motor swivel surface 40*a* of FIG. 9 of the shockproofer turret. The shockproofer turret floor 36 rests above a race plate 44, which is held away from the shockproofer base 41 as will be described below. The full action by the shockproofer 31 is surprisingly coordinated, and the action under the forces applied by the manually operated key, to be described below, is similarly coordinated.

Figure 11:
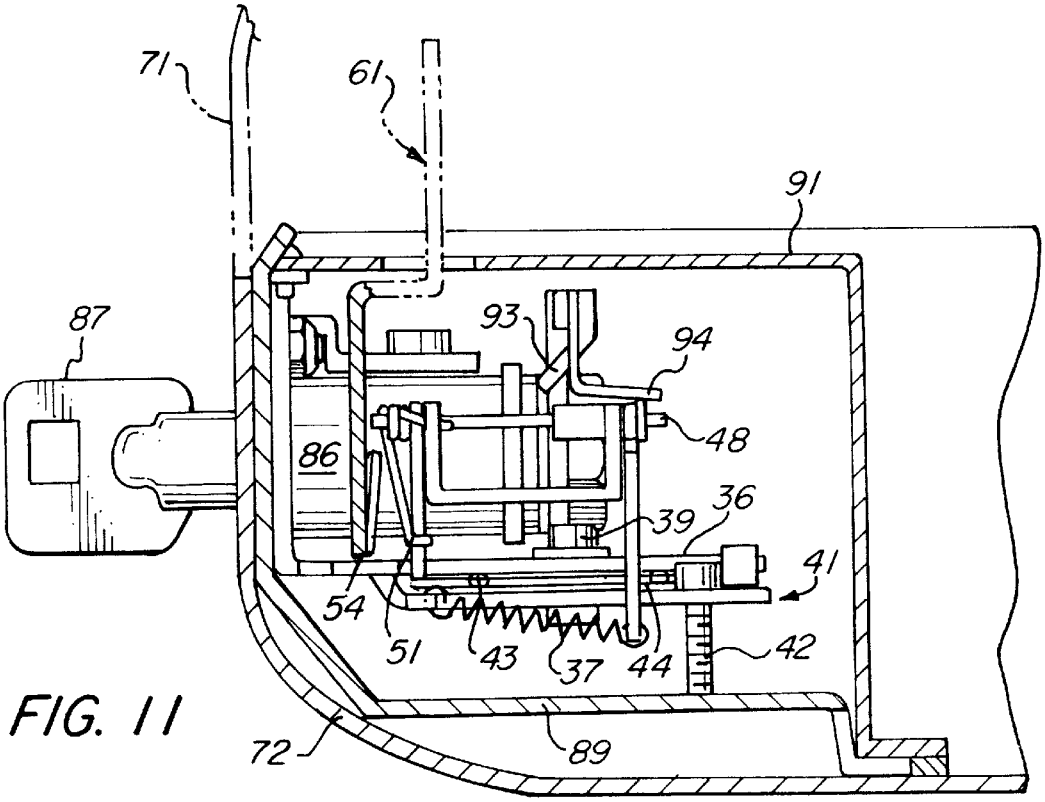
FIG. 11 is a fragmentary enlarged cross-sectional internal elevation view showing a key as a manual driver actuating the shockproofer.

FIG. 11 is another view of a cross-section of the locking mechanism, showing more clearly how the mechanism is integrated into the base of the case 72. This view shows the race plate 44 housing several loosely staked captive ball bearings 43. The ball bearings prevent the turret floor from binding on the shockproofer base 41 while the shockproofer turret floor and turret cap are swiveled about the turret post 39. The view in FIG. 11 is from the position of the motor so that the key 87 and keylock cylinder 86 are visible through the shockproofer structure.

Figure 12A:
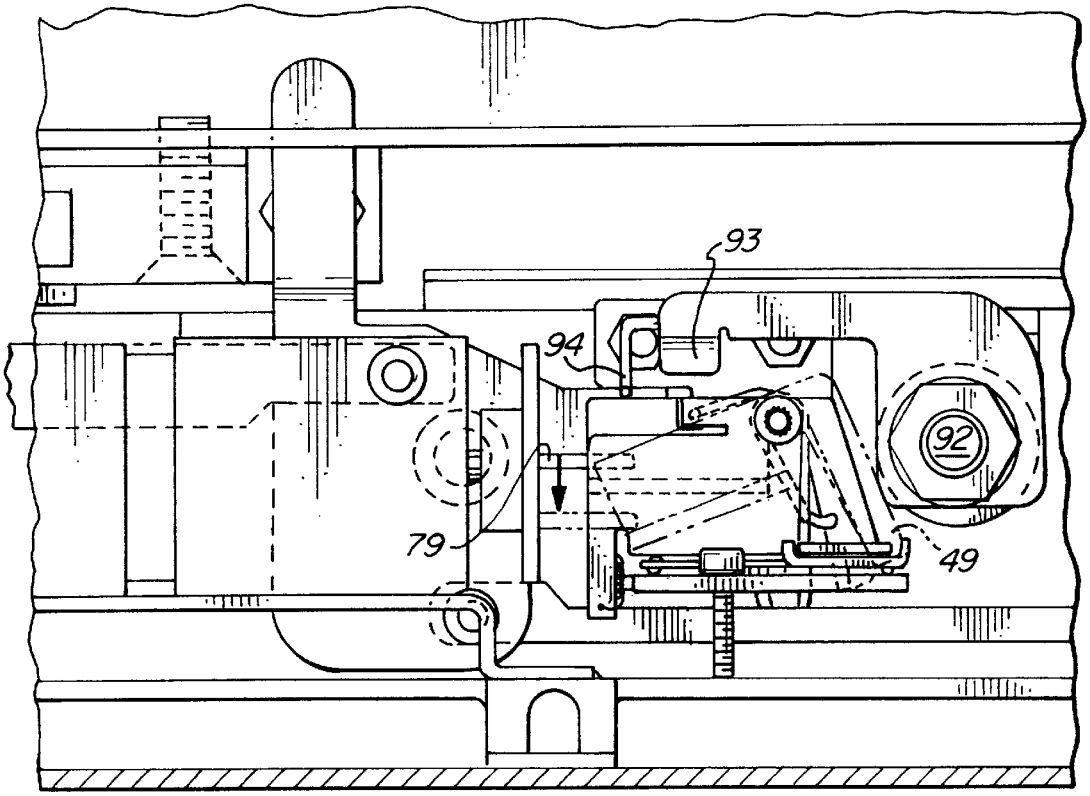
FIG. 12A and FIG. 12B show two internal elevation views of the handgun case, both looking from the inside toward the locking mechanism of the present invention, illustrating the tilting and then swiveling of components of the shockproofer and the resulting rotation of the lockbar lever.
Figure 12B:
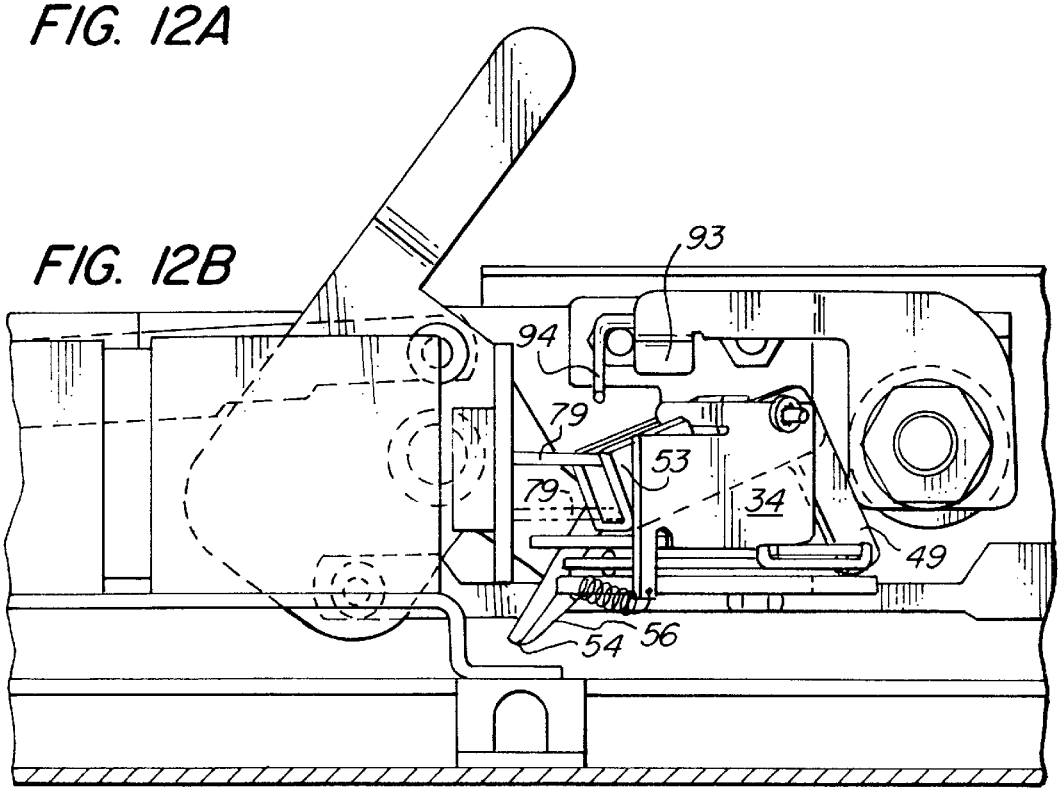

FIGS. 12A and 12B show two views illustrating how the turret elements are first tilted and then swiveled by a motor. FIG. 12A shows how the motor disc pin 79, at the first sector in its pivoting rotation, pushes down on the tilt surface 35 of the turret cap, lifting the turret lid finger 49 out from the base notch 52 of FIG. 9. In FIG. 12B, the motor disc pin has rotated through 180 degrees so that it has completed swiveling the turret cap and shockproofer turret, allowing the locking lever arm to be pulled down under the action of the lockbar spring 67 of FIG. 9. In FIG. 12B, the locking lever stop 54 is shown extending downward between the shockproofer mechanism and the base 72 of the case.

Figure 13A:
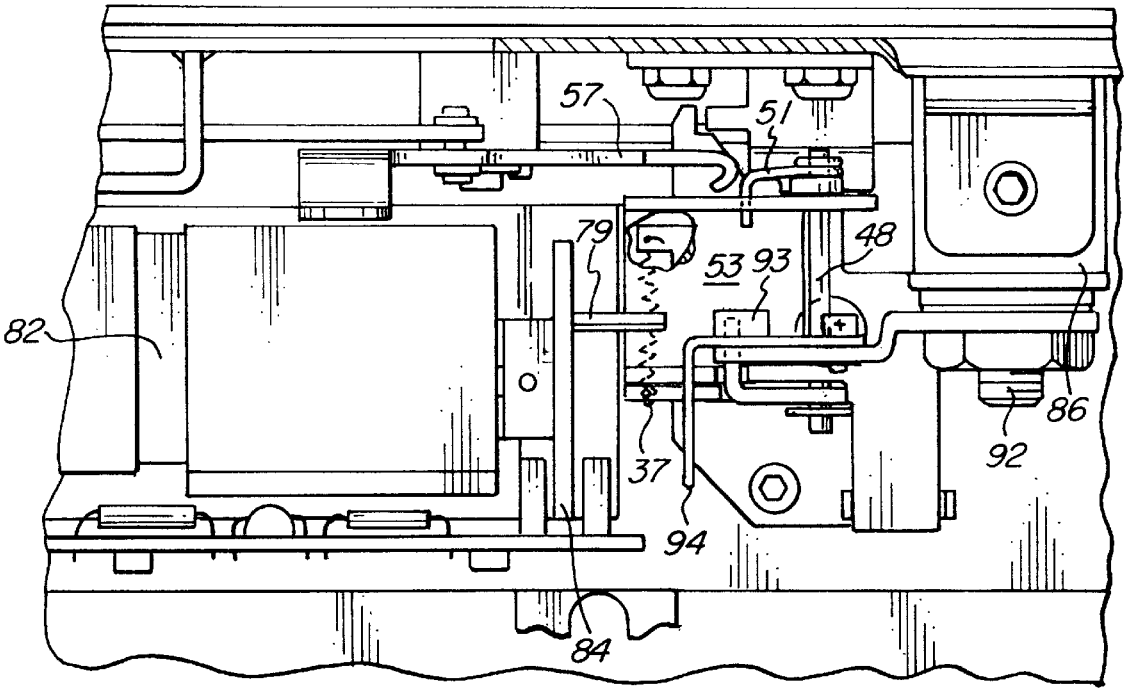
FIG. 13A and FIG. 13B show two internal top plan views of the handgun case, illustrating the same tilting and then swiveling of components of the shockproofer as shown in FIGS. 12A and 12B.
Figure 13B:
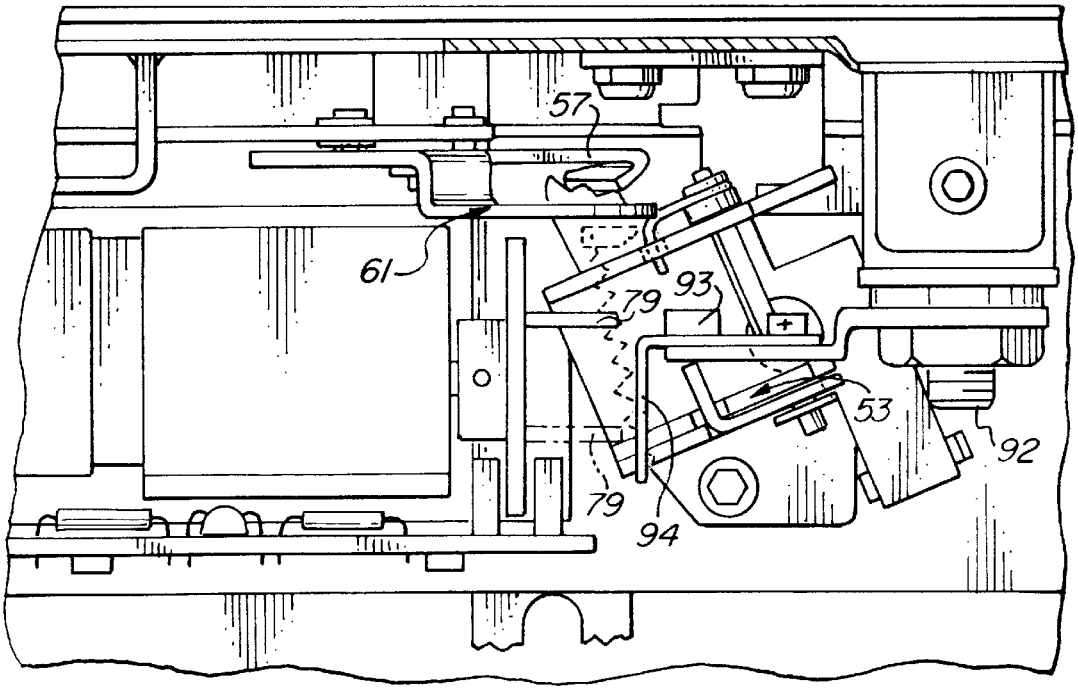

FIGS. 13A and 13B show the same action shown in FIGS. 12A and 12B, but looking at the locking assembly from above. In FIG. 13A, the motor disc pin 79 is at the beginning of its downward travel and is pushing against the motor tilt surface 35*a* (FIG. 9) of the turret cap 53. In FIG. 13B, the motor disc pin 79 is shown to have moved through 180 degrees of its rotation and so to have pushed against the motor swivel surface 40*a* of the turret cap 53 and caused the turret cap and shockproofer turret 34 to have swiveled about the turret post 39 of FIGS. 9 and 11.

Figure 14A:
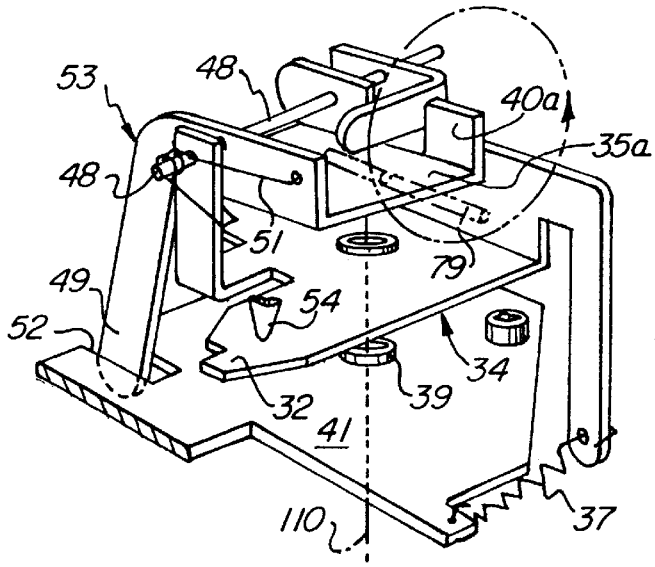
FIGS. 14A, 14B, and 14C are successive fragmentary perspective views of the tilting and swiveling action of the shockproofer under forces applied by a pin on a motor-driven disc.
Figure 14B:
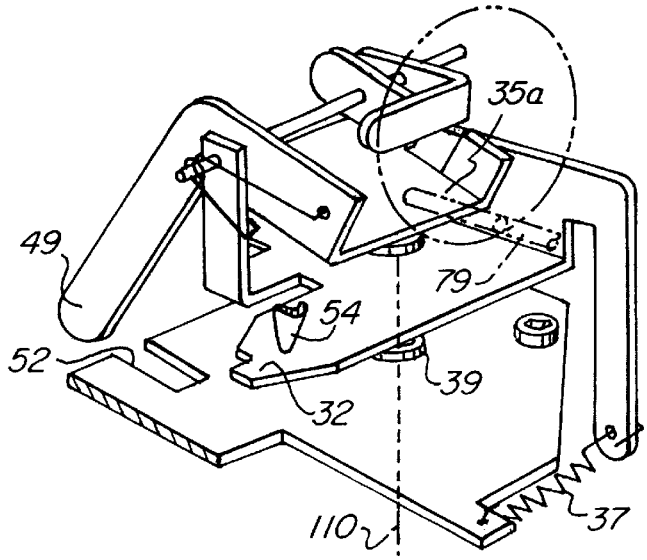
Figure 14C:
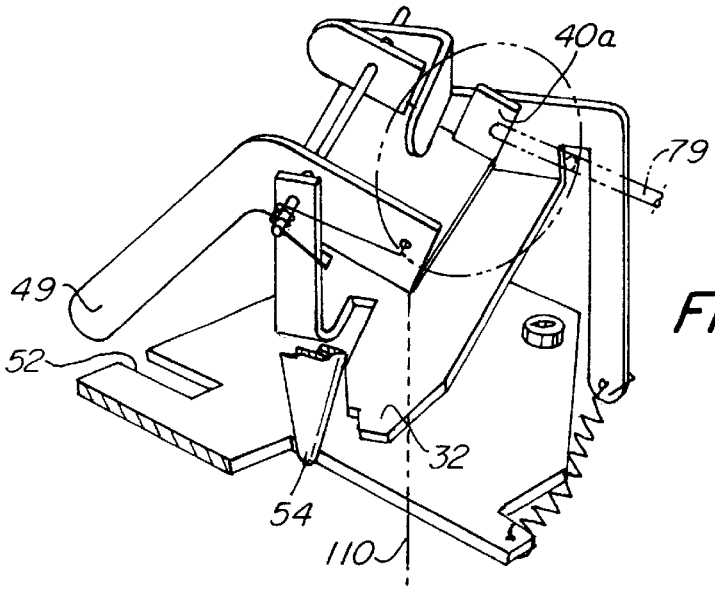

FIGS. 14A, 14B, and 14C further illustrate the tilting and swiveling action of the shockproofer, caused by a motor. In these figures, to more clearly illustrate the action, some of the components are not drawn to the same scale as before. In FIG. 14A, the motor disc pin 79 is shown at the start of its travel. As the motor disc (not shown) turns, the motor disc pin 79 follows the trajectory indicated by the dashed curved line. The first surface of the shockproofer that the motor disc contacts is the motor tilt surface 35*a*. As the motor disc pin continues its travel, it depresses the turret cap 53 by pushing on the motor tilt surface 35*a*, causing the turret cap to pivot about axis 113 of the turret cap shaft 48. The turret cap spring 51 (FIGS. 9 and 11) opposes this tilting, offering a restoring force toward the untilted state.

In FIG. 14B, the turret cap 53 is shown tilted about the turret cap shaft 48, and the turret cap finger 49 is shown lifted from the base notch 52 in the shockproofer base 41, so that the turret 34 is mechanically able to be swiveled about the turret post 39. In FIG. 14C this swiveling action is shown caused by the motor disc pin 79 in its circular travel pushing against the motor swivel surface 40*a*. Pushing against this surface forces the turret 34 and the turret cap 53 to swivel about the turret post axis 110 of the turret post 39. The turret spring 37 opposes this swiveling, offering a restoring force toward the unswiveled state.

The net effect of this combined tilting and swiveling is to move the shockproofer tab 32 out from beneath the locking lever stop 54 (FIG. 9), allowing the lockbar assembly to retract the lockbars, disengaging the locking mechanism.

Figure 15A:
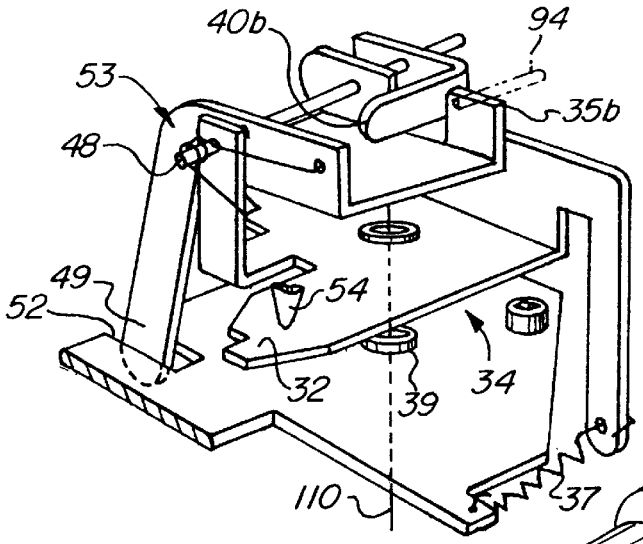
FIGS. 15A, 15B, and 15C are corresponding perspective views of the tilting and swiveling action of the shockproofer under forces applied by a manually rotated key.
Figure 16:
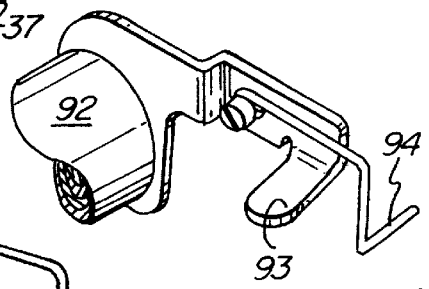
FIG. 16 is a perspective view of part of the keying mechanism in one embodiment, showing the key arm and key finger that cause the tilting and swiveling action of the shockproofer.
Figure 17A:
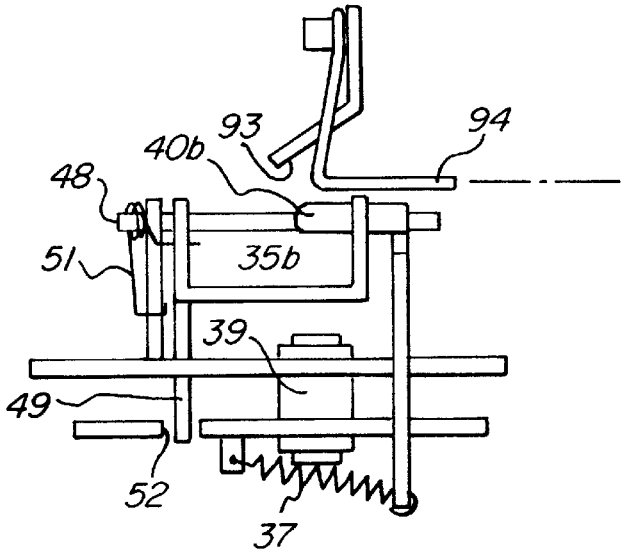
FIGS. 17A, 17B, and 17C are perspective views corresponding to the perspective views of FIGS. 15A, 15B, and 15C, showing the tilting and swiveling action of the shockproofer under forces applied by a manually rotated key.
Figure 17B:
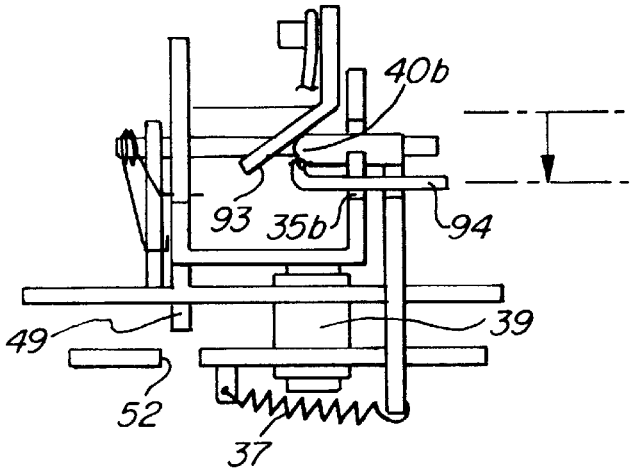
Figure 17C:
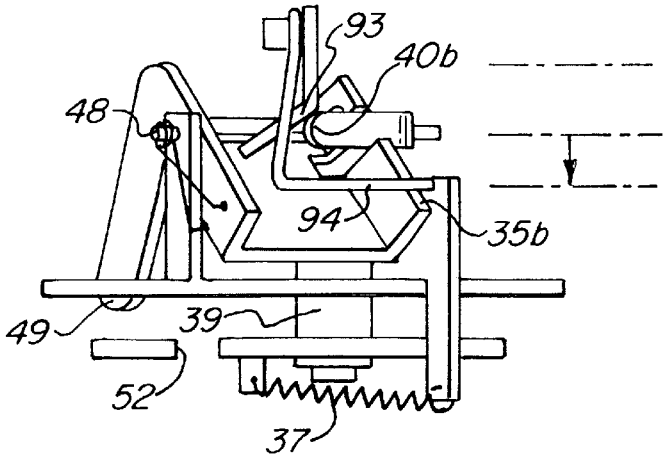

FIGS. 15A, 15B, and 15C again illustrate the tilting and swiveling action of the shockproofer, but this time the action is shown caused by manually turning a key, which rotates a key finger 94 and key arm 93 about the key shaft 92 (FIG. 12A and FIG. 16). FIGS. 17A, 17B, and 17C are perspective views showing the same key-driven tilting and swiveling action as FIGS. 15A, 15B, and 15C, respectively.

In FIG. 15A, the key finger 94 (see also FIG. 16) is shown in contact with the key tilt surface 35*b*. By rotating the key in the key cylinder, the key finger, acting as a cam, is forced to press down on the key tilt surface 35*b*, acting as a cam follower, which tilts the turret cap 53 about axis 113 of the turret cap shaft 48, just as in the tilting action caused by the motor. The tilting action caused by the motor and the action caused by the key differ only in that the key finger and the motor disc pin press on two different portions of the turret cap surface, but the tilting action of the turret cap is identical.

Figure 15B:
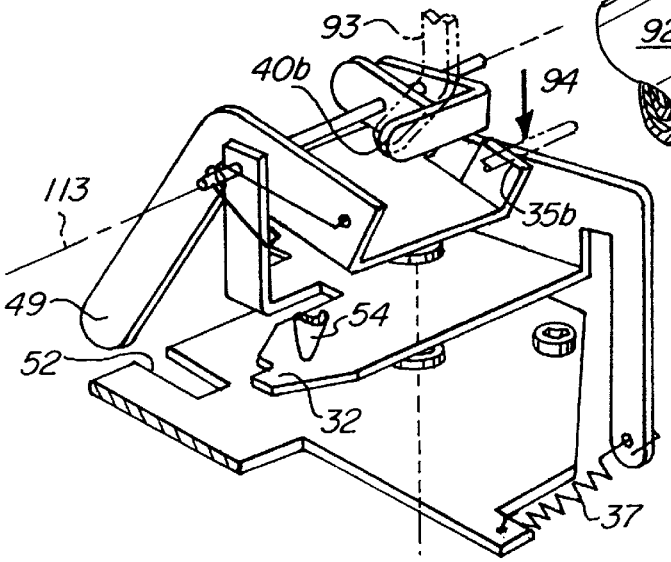
Figure 15C:
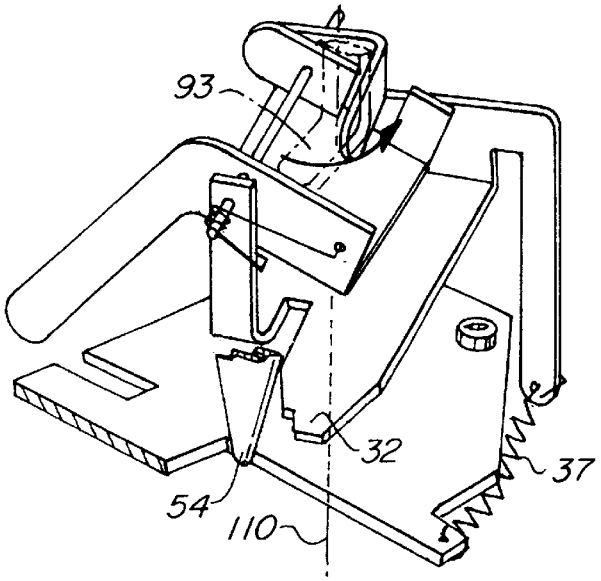

FIG. 15B shows the turret cap tilted and ready, along with the turret, to be swiveled. Again, just as in the tilting caused by the motor, the turret cap finger 49 is out of the base notch 52, so that the turret is mechanically able to be swiveled. As the key is further turned in the key cylinder, the key arm 93 presses down on the key swivel surface 40*b*, swiveling the turret and turret cap about the turret post axis 110 centered on the turret post 39. In this swiveling action, the key arm 93 acts as the cam, and the key swivel surface 40*b* acts as the cam follower. Just like the shockproofer turret cap can be tilted the same way by two different means, the swiveling action here and that caused by the motor differ only in that a different portion of the turret cap surface is pressed. The swiveling caused by the two means is identical in all other respects. FIG. 15C shows the shockproofer in its tilted and swiveled state; as the shockproofer reaches this state, stop 54 is released by shockproofer tab 32, and lockbar spring 67 (FIG. 9) retracts lockbars 62 and 63 (FIG. 9) to disengage the lock.

Figure 18:
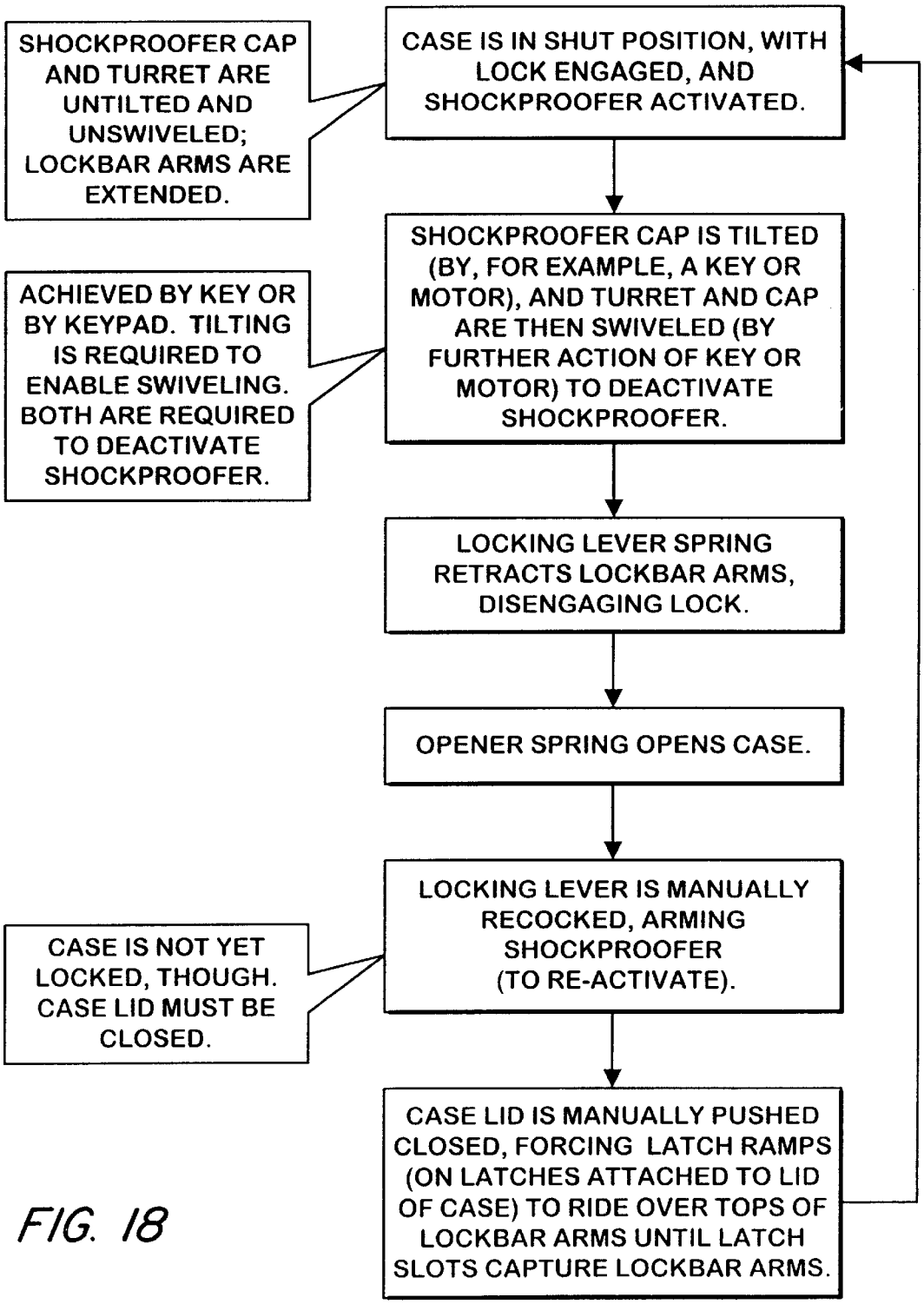
FIG. 18 is a process diagram indicating the sequence of the events that occur in the operation of the locking mechanism of the present invention.

FIG. 18 is a process diagram, representing the operation of the present invention when used in a portable security container. The diagram points out that the shockproofer may be tilted and swiveled by, for example, a key or a motor. As a result of this tilting and swiveling, the locking lever spring is can retract the lockbar arms, disengaging the locking mechanism. To lock the container, the locking mechanism first must be armed by recocking the locking lever. Until then, the container can be closed but will not lock. Once the locking lever is cocked, when the case is closed, the latch ramps will ride over the tops of the lockbar arms, catch the lockbar arms, and lock the container.

As can be understood from the disclosure of both the automobile door and security case embodiments, the locking mechanism of the present invention is absolutely shockproof. To disengage the lock, the shockproofer must be forced to pivot about a first axis and then about a second axis. This second pivoting is mechanically prevented unless the force causing the first pivoting is at least partially sustained until the second pivoting is begun. If the first pivoting force is removed before the second pivoting force is applied, the shockproofer will de-tilt, which will result in the turret cap finger 49 lowering back into the base notch 52, mechanically preventing the required swiveling. Shock loading cannot ever disengage the locking mechanism of the present invention, because shock loading cannot apply simultaneously two forces in different directions.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

Having now disclosed the invention, what is claimed is:

1. A lock for holding together in latched engagement two movably connected first and second segments of a protective shell structure, latchable together along respective mating latching edges and separable by relative movement to afford access to an interior chamber enclosed by said shell when said segments are latched together, comprising a pair of latches each pivotably anchored by a latch pivot to the interior of said first shell segment and resiliently biased toward inwardly protruding latched positions juxtaposed in spaced-apart facing relationship, means forming a latch slot in each said latch, a cam follower ramp aligned with said slot, terminating each said latch, a pair of lockbar arms having beveled distal cam ends and adjacent proximal ends, mounted on the interior of said second shell segment for sliding movement, between a locked extended position, wherein the distal cam end of each lockbar arm is engaged extending through the latch slot of one said latch, and an unlocked retracted position, wherein the distal cam end of each lockbar arm is withdrawn from its latch slot, first resilient spring means urging said lockbar arms toward said retracted unlocked positions, a locking lever, pivotably mounted to a pivot shaft on the interior of said second shell segment, having a handle protruding in a first direction toward said first shell segment and having a lever stop protruding from said lever, with crank pivots joining the proximal ends of the lockbar arms to the locking lever at crank arm distances on opposite sides of said pivot shaft along a direction substantially parallel to said first direction, said locking lever being movable between a first locked position with said lockbar arms extended and a second unlocked position with said lockbar arms retracted, a shockproofer turret pivotably mounted inside said second shell segment, with a turret cap mounted thereon for first tilting movement about a first tilt axis substantially parallel to said pivot shaft past a restraining edge, freeing said shockproofer turret for subsequent swiveling movement about a second swivel axis extending in an independent and different direction from said tilt axis, with a shockproofer tab extending substantially perpendicular to said swivel axis into blocking engagement with said protruding lever stop until after said swiveling movement occurs, second resilient spring means urging the shockproofer turret toward its unswiveled position with the tab blocking the lever stop, third resilient spring means urging the turret cap toward its untilted position, and at least one unlocking means in said second shell segment presented for actuation by a user outside said shell and connected upon actuation to first induce said turret cap tilting and thereafter to induce said shockproofer turret swiveling, releasing said tab from blocking engagement with said locking lever stop, whereby said locking lever is freed for movement to its unlocked position, urged by said first resilient spring via said lockbar arms acting through said crank pivots.

2. A lock as defined in claim 1, wherein the shockproofer turret is firmly attached to a shockproofer base having a turret post that extends parallel to the swivel axis, and incorporates a turret post hole, the shockproofer turret journaled on said post about which the shockproofer turret swivels, the shockproofer turret having, adjacent to the shockproofer base, a race plate holding a plurality of loosely staked ball bearings that roll on the shockproofer base as the shockproofer turret swivels about the turret post, thereby helping prevent the shockproofer turret from binding on the turret post as it swivels about the turret post.

3. A lock as defined in claim 1, wherein the turret cap has a turret cap shaft journaled in the shockproofer turret about which the turret cap tilts.

4. A lock as defined in claim 1, wherein one of said at least one unlocking means comprises a key, a key lock mounted in said second shell segment, the key lock having a key shaft that extends into the interior of the second segment of the protected shell structure, the key shaft having a key finger that extends at approximately a right angle from the key shaft toward the shockproofer and has an angled cam end for pushing on a first cam follower surface of the turret cap for causing the tilting movement of the turret cap, the key shaft also having a key arm that protrudes at approximately a right angle from the key shaft toward the turret cap and having an angled cam end for co-acting with a second cam follower surface of the turret cap to cause the swiveling movement of both the shockproofer turret and turret cap.

5. A lock as defined in claim 1, wherein one of said at least one unlocking means comprises a motor, the motor making one complete revolution when actuated, and having a motor disc with a motor disc pin protruding toward the shockproofer, the motor disc pin, as the motor turns, engaging a first surface of the turret cap and causing a tilting action of the turret cap, and then engaging a second surface of the turret cap and causing the swiveling action of both the shockproofer turret and turret cap.

6. A lock as defined in claim 1, wherein in closing movement of the first and second segments of the protected shell structure, the cam follower ramp of each latch rides down on the distal cam end of a lockbar arm thereby pivoting each latch about its latch pivot until the lockbar arm drops into the latch slot.

7. A lock as defined in claim 1, wherein associated with the shell is an opener spring adapted to be firmly attached to the second shell segment having an opener spring arm resiliently biased toward the first shell segment, thereby forcing the first segment of the protected shell structure apart from the second segment, when the lock is disengaged.

8. An assembly as defined in claim 7, wherein associated with the lock is an opening guide, adapted to be pivotally attached to both the first segment and the second segment of the shell structure, for damping the action of the opener spring arm, thereby providing that the first segment of the protected shell structure will separate smoothly from the second segment.

9. A lock for holding together in latched engagement two movably connected first and second segments of a protective shell structure, latchable together along respective mating latching edges and separable by relative movement to afford access to an interior chamber enclosed by said shell when said segments are latched together, comprising a shockproofer having rotatable elements including a turret cap that tilts about a first axis and further including a turret which along with said cap the swivels about a second axis different from the first axis, wherein the tilting and swiveling motions are executed in three dimensions, and further comprising a means for tilting and then swiveling the rotatable elements, a lockbar assembly having at least one lockbar arm that extends and retracts, and means connected to the first segment forming a lockbar arm receiver for the at least one lockbar arm, wherein the lock is engaged when the at least one lockbar arm is extended so as to pierce its lockbar arm receiver and the lock is disengaged when the at least one lockbar arm is retracted from its lockbar arm receiver and wherein the at least one lockbar arm is prevented from retracting by a positive latching mechanism, comprising a holding assembly resiliently holding a surface of said turret cap in a notch of the shockproofer, the notch mechanically preventing the swiveling motion until the force of the holding assembly is overcome by a downward force acting on said turret cap.

10. A lock for holding together in latched engagement two movably connected first and second segments of a protective shell structure, latchable together along respective mating latching edges and separable by relative movement to afford access to an interior chamber enclosed by said shell when said segments are latched together, comprising a lockbar arm receiver adapted to be anchored to the first shell segment, a lockbar arm mounted on the interior of said second shell segment for sliding movement between a locked extended position, wherein a distal end of the lockbar arm is engaged extending through the lockbar arm receiver, and an unlocked retracted position, wherein the distal end of the lockbar arm is withdrawn from the lockbar arm receiver, a first resilient spring means urging the lockbar arm toward said retracted unlocked position, a locking lever, pivotally mounted to a pivot shaft on the interior of said second shell segment, having a handle protruding in a first direction and having a lever stop protruding from said lever, with a crank pivot joining the proximal end of the lockbar arm to the locking lever at a crank arm distance from said pivot shaft along a direction substantially parallel to said first direction, said locking lever being movable between a first locked position with the lockbar arm extended and a second unlocked position with the lockbar arm retracted, a shockproofer turret pivotally mounted inside said second shell segment, with a turret cap mounted thereon for first tilting movement about a first tilt axis substantially parallel to said pivot shaft past a restraining edge, freeing said shockproofer turret for subsequent swiveling movement about a second swivel axis extending in an independent and different direction from said tilt axis, with a shockproofer tab extending substantially perpendicular to said swivel axis into blocking engagement with said protruding lever stop until after said swiveling movement occurs, second resilient spring means urging the shockproofer turret toward its unswiveled position with the tab blocking the lever stop, third resilient spring means urging the turret cap toward its untilted position, and at least one unlocking means in said second shell segment presented for actuation by a user outside said shell and connected upon actuation to first induce said turret cap tilting and thereafter to induce said shockproofer turret swiveling, releasing said tab from blocking engagement with said locking lever stop, whereby said locking lever is freed for movement to its unlocked position, urged by said first resilient spring via said lockbar arm acting through said crank pivot.

11. A lock as defined in claim 10, wherein the shockproofer turret is firmly attached to a shockproofer base having a turret post that extends parallel to the swivel axis, and incorporates a turret post hole, the shockproofer turret journaled on said post about which the shockproofer turret swivels, the shockproofer turret having, adjacent to the shockproofer base, a race plate holding a plurality of loosely staked ball bearings that roll on the shockproofer base as the shockproofer turret swivels about the turret post, thereby helping prevent the shockproofer turret from binding on the turret post as it swivels about the turret post.

12. A lock as defined in claim 10, wherein the turret cap has a turret cap shaft journaled in the shockproofer turret about which the turret cap tilts.

13. A lock as defined in claim 10, wherein one of said at least one unlocking means comprises a key, a key lock mounted in said second shell segment, the key lock having a key shaft that extends into the interior of the second segment of the protected shell structure, the key shaft having a key finger that extends at approximately a right angle from the key shaft toward the shockproofer and has an angled cam end for pushing on a first cam follower surface of the turret cap for causing the tilting movement of the turret cap, the key shaft also having a key arm that protrudes at approximately a right angle from the key shaft toward the turret cap and having an angled cam end for co-acting with a second cam follower surface of the turret cap to cause the swiveling movement of both the shockproofer turret and turret cap.

14. A lock as defined in claim 10, wherein one of said at least one unlocking means comprises a motor, the motor making one complete revolution when actuated, and having a motor disc with a motor disc pin protruding toward the shockproofer, the motor disc pin, as the motor turns, engaging a first surface of the turret cap and causing a tilting action of the turret cap, and then engaging a second surface of the turret cap and causing the swiveling action of both the shockproofer turret and turret cap.

15. A lock as defined in claim 10, wherein associated with the shell is an opener spring firmly attached to the second shell segment having an opener spring arm resiliently biased toward the first shell segment, thereby forcing the first segment of the protected shell structure apart from the second segment, when the lock is disengaged.

16. An assembly as defined in claim 15, wherein associated with the lock is an opening guide, pivotably attached to both the first segment and the second segment of the shell structure, for damping the action of the opener spring arm, thereby providing that the first segment of the protected shell structure will separate smoothly from the second segment.

17. A lock as defined in claim 10, further comprising a second lockbar arm receiver, wherein the two lockbar arm receivers, in combination, comprise a pair of latches each pivotally anchored by a latch pivot to the interior of said first shell segment and resiliently biased toward inwardly protruding latched positions juxtaposed in spaced-apart facing relationship, means forming a latch slot in each said latch, and a cam follower ramp aligned with said slot, terminating each said latch.

18. A lock as defined in claim 10, incorporating a pair of lockbar arms having beveled distal cam ends and adjacent proximal ends, mounted on the interior of said second shell segment for sliding movement, between a locked extended position, wherein the distal cam end of each lockbar arm is engaged extending through the latch slot of one said latch, and an unlocked retracted position, wherein the distal cam end of each lockbar arm is withdrawn from its latch slot.

19. A lock as defined in claim 18, wherein in closing movement of the first and second segments of the protected shell structure, the cam follower ramp of each latch rides down on the distal cam end of a lockbar arm thereby pivoting each latch about its latch pivot until the lockbar arm drops into the latch slot.

* * * * *

UNITED STATES PATENT AND TRADEMARK OFFICE

CERTIFICATE OF CORRECTION

PATENT NO. : 5,881,584

DATED : March 16, 1999

INVENTOR(S) : Brunoski et al.

It is certified that error appears in the above-identified patent and that said Letters Patent is hereby corrected as shown below:

At column 3, line 42, "-" should be deleted.

At column 4, line 57, "hows" should read --shows--.

At column 8, line 63 "is" should be deleted.

At column 11, line 14, before "cap" --turret-- should be inserted.

At column 11, line 14 "the" should read --then--.

At column 11, line 23 and 24 after "receiver" --,-- should be inserted.

Signed and Sealed this

Twentieth Day of July, 1999

*Attest:*

*Attesting Officer*

Q. TODD DICKINSON

*Acting Commissioner of Patents and Trademarks*